US005285545A

United States Patent [19]

Payne et al.

[11] Patent Number: 5,285,545

[45] Date of Patent: Feb. 15, 1994

[54] ELECTRONIC LAUNDRY CONTROL WITH FILL TIME COMPENSATION

[75] Inventors: Thomas R. Payne; Steven A. Rice; William W. Wead, all of Louisville, Ky.

[73] Assignee: General Electric Company, Louisville, Ky.

[21] Appl. No.: 968,831

[22] Filed: Oct. 30, 1992

[51] Int. Cl.[5] ..... D06F 33/02; D06F 39/08

[52] U.S. Cl. ..... 8/158; 68/12.05; 68/12.12; 68/12.21

[58] Field of Search ..... 8/158, 159; 68/12.01, 68/12.02, 12.05, 12.12, 12.19, 12.21, 12.27, 207

[56] References Cited

U.S. PATENT DOCUMENTS

| | | | |
|---|---|---|---|
| 4,216,461 | 8/1980 | Werth et al. | 340/149 |
| 4,245,310 | 1/1981 | Kiefer | 68/12.19 X |
| 4,306,219 | 12/1981 | Main et al. | 340/825.54 |
| 4,369,442 | 1/1983 | Werth et al. | 340/825.35 |

FOREIGN PATENT DOCUMENTS

| | | | |
|---|---|---|---|
| 211489 | 11/1984 | Japan | 68/207 |
| 77793 | 5/1985 | Japan | 68/12.19 |
| 15096 | 1/1989 | Japan | 68/12.02 |

*Primary Examiner*—Philip R. Coe
*Attorney, Agent, or Firm*—H. Neil Houser

[57] ABSTRACT

An appliance electronic control system which tends to maintain a constant total cycle time, and thus an accurate "Time Remaining" display, notwithstanding variations in the actual time required for a water fill operation. The control system includes a count down timer and a time remaining display indicating cycle time remaining based on the state of the count down timer. The count down timer is initialized to a state representing nominal total cycle time, which includes the sum of a nominal fill time for water filling operations, a nominal time duration for each of several pause intervals, and the time durations of operational modes under the direct control of the control system, such as agitate time and spin time. During operation, the count down timer is decremented at regular predetermined intervals. The first time the machine fills, the actual time for the filling operation is measured. If the machine takes time less than the nominal fill time to fill (fast fill), the pause intervals are lengthened to compensate for the unused time allocated for the fill. If the machine takes more time than the nominal fill time to fill (slow fill), the pause intervals are shortened to compensate for the extra time required for the fill. In situations where the actual fill time exceeds the compensation capability, a one-time adjustment of the "Time Remaining" count down timer occurs at an appropriate point in the cycle. A safety feature to prevent excessive flooding due to faulty water level sensors is included.

15 Claims, 4 Drawing Sheets

44
S2
S4
S6
S8
S10
S1
S3
S5
S7
S9
SPEED
HOT
COLD
WARM
38'
32
30
43
34
29
START
RUN
36
40
42
20
26
RL 1
RL 2
RL 3
RL 4
RL 5
24
46
DISPLAY
RAM
23
48
22
L1
N
31
28

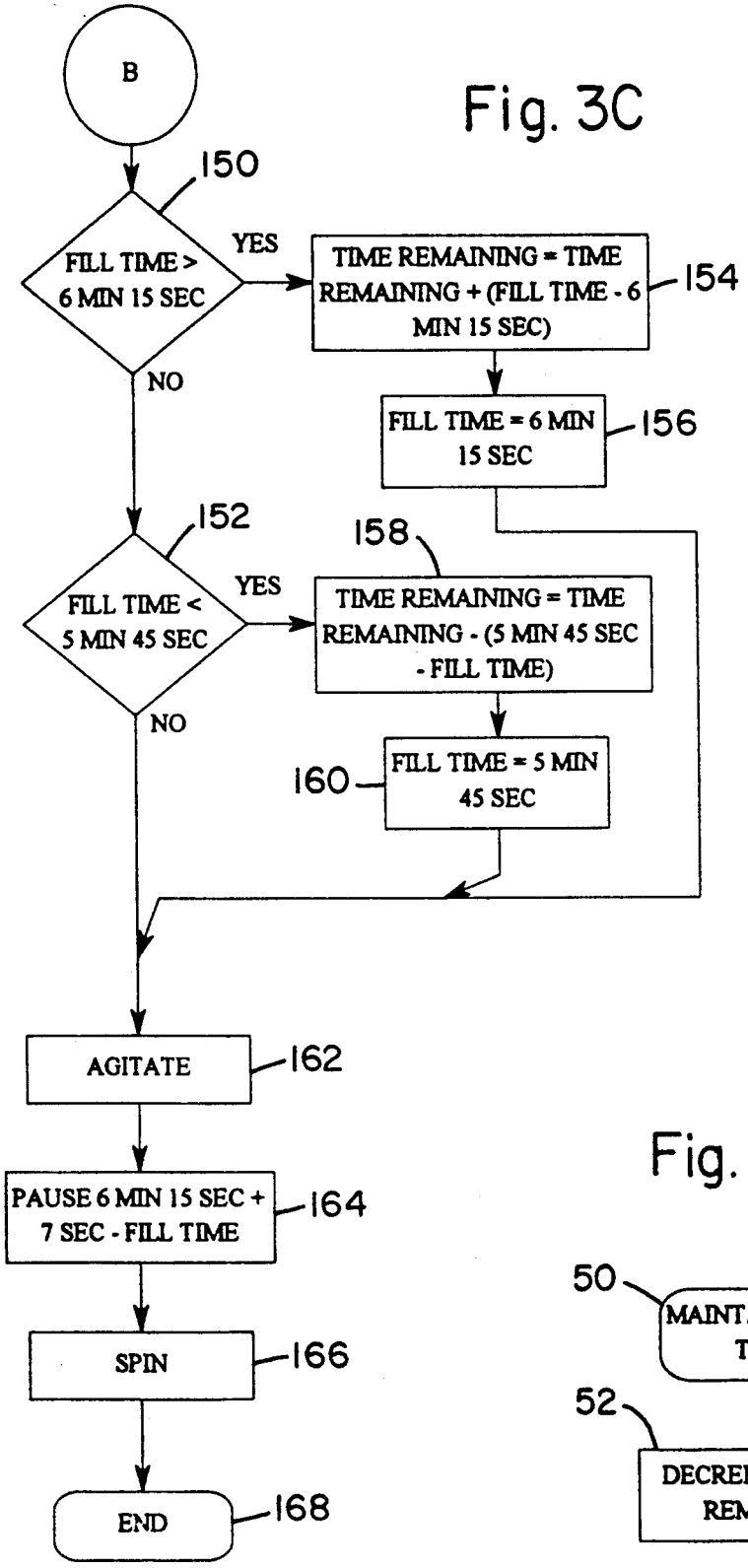
Fig. 3C
Fig. 2
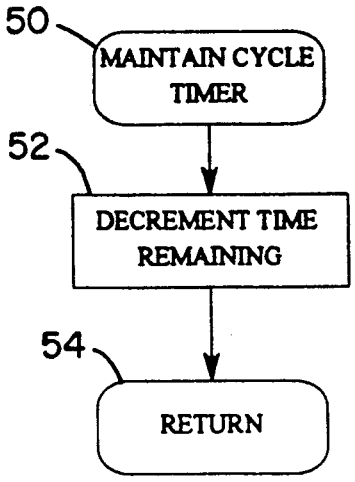

A

112
FILL TIME > 3 MIN 15 SEC
YES
NO
120
PAUSE 7 SEC
122
FILL TIME = FILL TIME - 15 SEC
114
FILL TIME < 2 MIN 45 SEC
YES
NO
124
PAUSE 30 + 7 SEC
126
FILL TIME = FILL TIME + 15 SEC
PAUSE 3 MIN 15 SEC + 7 SEC - FILL TIME
116
FILL TIME = 3 MIN
118
130
RESET FLOOD TIMER
132
TURN ON WATER
134
FLOOD TIMER > 16 MINUTES
YES
NO
136
STOP MACHINE AND WAIT FOR INPUT
INCREMENT FLOOD TIMER AND FILL TIME
138
140
WATER FULL ?
NO
YES
142
TURN OFF WATER
B

ELECTRONIC LAUNDRY CONTROL WITH FILL TIME COMPENSATION

BACKGROUND OF THE INVENTION

The present invention relates generally to electronic appliance controllers and, more particularly, to an appliance electronic control system which tends to maintain a constant total cycle time, and thus an accurate "Time Remaining" display, notwithstanding variations in the actual time required for a water fill operation.

The subject invention may be implemented as a part of an appliance electronic control system which is disclosed in concurrently-filed application Ser. No. 07/968,991, filed Oct. 30, 1992, by Thomas R. Payne and Steven A. Rice, entitled "Reconfigurable Appliance Electronic Control System with Automatic Model Determination, Internally Restructurable Control and Flexible Programmable Test Modes", and concurrently-filed application Ser. No. 07/969,139, filed Oct. 30, 1992, by Thomas R. Payne, William W. Wead and Steven A. Rice, entitled "Appliance Electronic Control System with Programmable Parameters Including Programmable and Reconfigurable Fuzzy Logic Controller", the entire disclosures of which are hereby expressly incorporated by reference.

Application Ser. No. 07/968,991 discloses a microcontroller-based electronic control system which is able to handle a variety of different appliances which are members of a family of commercial laundry products In a particular embodiment disclosed, the appliance electronic control system is applicable to each of a two-speed clothes washer, a one-speed clothes washer, an electronic dryer and a gas dryer.

A desirable feature in such appliances is a "Time Remaining" display which indicates cycle time remaining based on the state of a count down timer maintained by the controller. In a commercial, coin-operated laundry environment, a dryer cycle is entirely time driven, so little difficulty is involved in maintaining an accurate "Time Remaining" display The controller simply initializes the count down timer with the total cycle time, and then decrements the count down timer at regular predetermined intervals.

However, a clothes washer is both time and event driven, such that an accurate measure of cycle time remaining is more difficult to achieve. Thus, in the case of a washing machine, in order to initialize the count down timer, the control system must sum the time requirements of the various portions of the cycle, referred to herein as operational modes. These operational modes include wash water fill time, soak time, wash agitate time, spin time, rinse fill time, rinse agitate time, final spin time, and several pauses that occur between these operational modes. The pauses are required in order to allow the machine to come to a complete stop upon completion of one operational mode and the commencement of another operational mode in certain situations. In particular, a washing machine would likely be damaged if an attempt were made to switch instantaneously from an agitate mode to a spin mode, since a change in motor direction is involved.

The operational mode times just mentioned are under the direct control of the controller, with the exception of wash water fill and rinse water fill. Since the cessation of water fill is event driven, based on closing of a water level sensor switch or equivalent, rather than time driven, the actual time required to fill is known only after the water fill has occurred. This prevents an accurate initializing of the count down timer and thus prevents an accurate display of time remaining in the wash cycle.

In the past, this problem has been addressed by simply stopping the timer during water filling operations. However, when such an approach is employed, the displayed "Time Remaining" has little actual meaning since the operational cycle is not complete after the number of displayed minutes.

Another approach in the context of an electronically-controlled washing machine is to maintain a history of each particular machine to learn the actual fill times for that particular machine. This may be accomplished using a data filtering technique whereby a running average is kept for the fill time, and running average data is used in a time calculation for determining nominal fill time. This approach would offer a great deal of accuracy in estimating cycle time and thus in displaying "Time Remaining", but the displayed time may be different for different machines. It is considered less desirable by many users, especially in commercial laundry applications, to have a number of machines sitting side by side with different displayed cycle times.

SUMMARY OF THE INVENTION

Accordingly, it is an object of the invention to provide a washing machine electronic control system which includes a "Time Remaining" display which is accurate notwithstanding variations in the actual time required for water filling operations.

It is a related object of the invention to provide a washing machine electronic control system which achieves a nominal total cycle time notwithstanding variations in actual time required for a water filling operation.

It is another object of the invention to provide a washing machine electronic control system which prevents excessive flooding in the event a water level sensor malfunctions.

When a conventional electromechanical timer having cams is employed to control a washing machine, there is a practical minimum duration for any operation, which is related to timer motor speed and cam construction. Pause intervals are typically thirty seconds, although much shorter pause intervals, for example seven seconds, would be sufficient to allow the washing machine motor to come to a complete stop before switching from one operational mode to another, for example, from agitate to spin.

In accordance with an overall aspect of the invention it is recognized that, when controlling the same washing machine with an electronic control capable of establishing time intervals of virtually any duration, it is possible to reduce the length of time of the pause intervals to the minimum needed to stop one type of motion and to start another type of motion, for example. However, if longer pauses remain in the operational cycle, they provide a means of compensating for actual fill times which differ from a nominal fill time.

During design, a nominal or characteristic fill time is determined, which may, for example, be calculated from the midrange of specified flow values for the particular water valve assembly employed. To some extent, water valve assemblies are able to maintain a constant flow even with variations in water pressure. However, this constant flow operation is by no means perfect, and variations in fill time accordingly do occur.

Total cycle time is determined in advance, and used to initialize a cycle timer which drives the "Time Remaining" display. When calculating total cycle time, the value of the nominal or characteristic fill time, for example three minutes for each fill, is included in the sum of the time durations of the operational modes. Rather than thirty seconds for the pause intervals, a nominal pause interval of, for example, fifteen seconds is established.

The first time the machine fills, the actual time for the filling operation is measured. If the machine takes, for example, less than three minutes to fill, the pause intervals are lengthened to compensate for the unused time allocated for the fill. If the machine takes, for example, more than three minutes to fill, the pause intervals are shortened to compensate for the extra time required for the fill.

It will be appreciated there is a limit to the compensation which can be achieved employing this approach. Thus, int he case of long fill time durations (slow fills), the pause intervals cannot be shortened to less than zero seconds. In the case of short fill time durations (fast fills), in principle the pause intervals could be lengthened as much as would be required to achieve full compensation; however, it is considered undesirable to have excessively long pause durations and an arbitrary limit, for example, thirty seconds, is established. In actual implementation, the pause intervals should not be shortened to less than a predetermined minimum which protects the mechanical components when changing from agitate to spin, for example seven seconds. To preserve a thirty-second range for compensation, rather than a thirty second maximum limit for pause durations, the maximum limit may be lengthened to thirty seven seconds.

In cases where the actual fill times exceed the compensation capability, one-time adjustment of the "Time Remaining" count down timer occurs upon completion of the second fill operation. Thus after the second fill is complete, the control determines the difference between the compensation required and the compensation that can actually be achieved by adjusting the duration of any remaining pause intervals. The timer is then "jumped" either forward of backward to reflect this amount of time.

In accordance with a more particular aspect of the invention, a washing machine electronic control system includes a count down timer and a time remaining display indicating cycle time remaining based on the state of the count down timer.

The electronic control system additionally includes control elements for effecting an operational cycle comprising a plurality of operational modes established in a sequence. The operational modes include at least one fill operation having a duration defined by the actual time required for a predetermined amount of liquid to enter a washing machine, and at least one pause interval. Typically, the operational cycle includes first and second fill operations, and first, second and third pause intervals. The first and second pause intervals comprise at least one initial pause interval and occur prior to the second fill operation, and the third pause interval comprises a subsequent pause interval, and occurs after the second fill operation. The operational cycle has a nominal total cycle time which includes a nominal fill time for each of the fill operations, and a nominal time duration for each of the pause intervals.

The control elements are operable to maintain the time remaining display by initializing the count down timer to a state representing the nominal total cycle time, and by decrementing the count down timer at regular predetermined intervals.

The control elements are additionally operable to measure the duration of the at least one fill operation, and to adjust the duration of the at least one pause interval to the extent possible to compensate for any difference between the duration of the at least one fill operation and the nominal fill time so as to tend to achieve the nominal total cycle time.

In embodiments providing for at least first and second pause intervals, the control elements are further operable, in the event the difference between the duration of the at least one fill operation, and the nominal fill time exceeds compensation that can be achieved by adjusting the duration of the first pause interval, to adjust the duration of the second pause interval to the extent possible to compensate for any remaining difference between the duration of the at least one fill operation and the nominal fill time so as to tend to achieve the nominal total cycle time.

In embodiments providing for first and second fill operations, the control elements are further operable to measure the duration of the second fill operation and to adjust the duration of the subsequent pause interval to the extent possible to compensate for any difference between the combined durations of the first and second fill operations and twice the nominal fill time to the extent not previously compensated for so as to tend to achieve the nominal total cycle time.

In situations where sufficient compensation cannot be achieved by adjusting the durations of pause intervals, then the state of the count down timer is adjusted, by way of a one-time correction, to a state which represents actual cycle time remaining.

In accordance with another aspect of the invention, the control system prevents excessive flooding in the event a liquid level sensor malfunctions, where the liquid level sensor is normally used to sense when the predetermined amount of liquid has entered the machine. A flood timer is maintained to track actual fill time during a filling operation, and actual fill time as tracked by the flood timer is periodically compared to a predetermined maximum value. Operation is terminated in the event the actual fill time exceeds the predetermined value.

BRIEF DESCRIPTION OF THE DRAWINGS

While the novel features of the invention are set forth with particularity in the appended claims, the invention, both as to organization and content, will be better understood and appreciated from the following detailed description, taken in conjunction with the drawings, in which:

FIG. 2 is a flowchart representing a routine to periodically decrement the cycle timer represented by the variable Time Remaining at predetermined intervals; and FIGS. 3A, 3B and 3C are a flowchart representing a control program.

DETAILED DESCRIPTION

Figure 1:
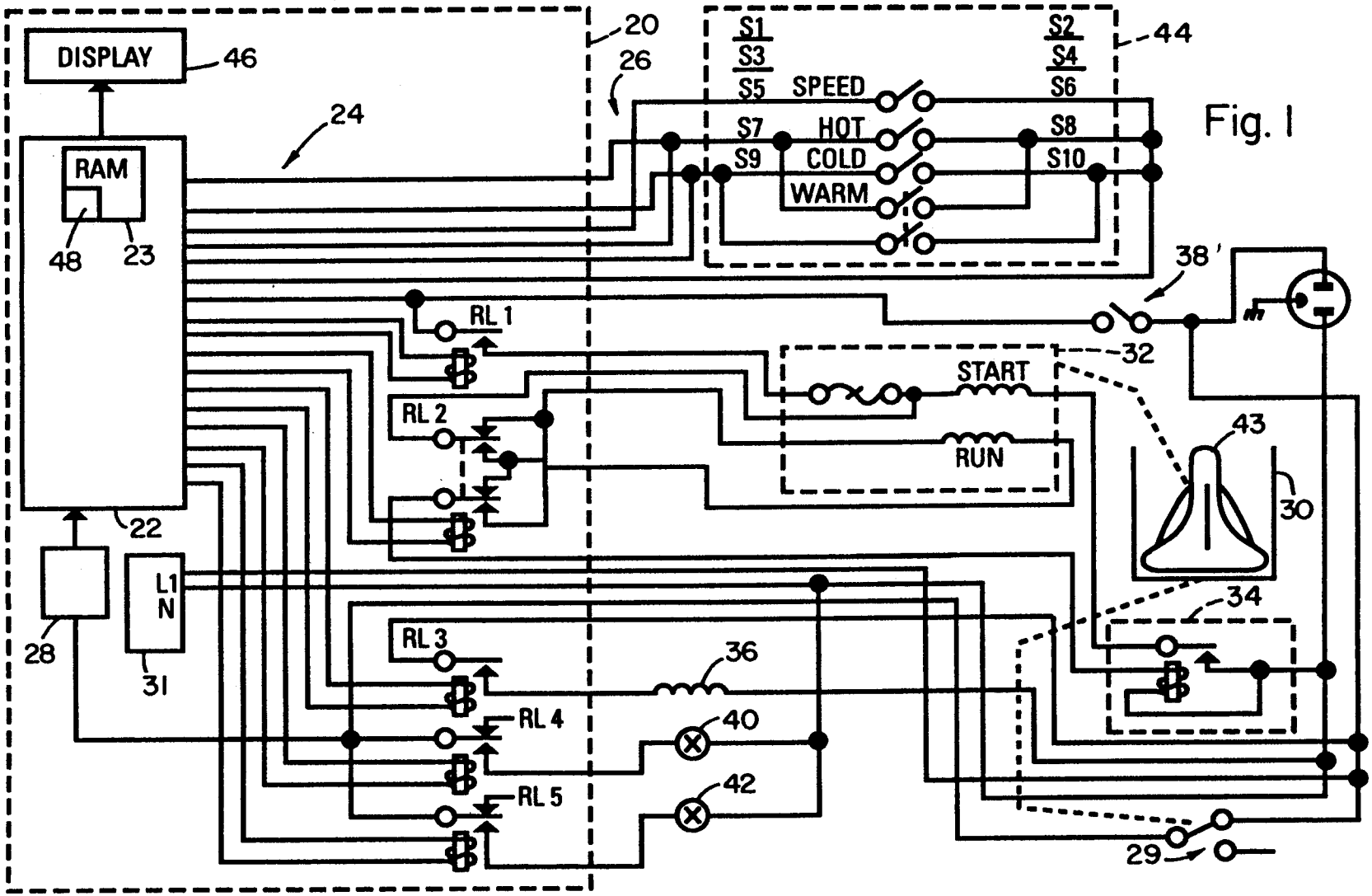
FIG. 1 is a schematic diagram of an appliance electronic control system connected for controlling a clothes washing machine.

Referring initially to FIG. 1, an appliance electronic control system 20 includes a suitably programmed microcontroller 22, for example, a Motorola 6805. Within the microcontroller 22 are memory elements 23 in the form of RAM memory, as well as ROM program memory. The microcontroller 22 includes input/output port lines, generally designated 24, which output signals for activating various functional elements within a clothes washing machine 26 and which receive various inputs. The microcontroller input/output lines 24 are connected to the functional elements within the washing machine 26 as shown in FIG. 1, in some cases directly, and in other cases through relays, in this case five relays respectively designated RL1, RL2, RL3, RL4 and RL5. For water level sensing, the control system 20 includes an opto-isolator 28 for interfacing 120 volts AC from a water level sensor 29 to an input of the microcontroller 22. The water level sensor 29 responds to incoming water filling a washing machine tub 30 reaching a predetermined level.

For powering the microcontroller 22 and other elements, a DC power supply 31 is included, which receives 120 volts AC from conductors L1 and N.

Included within the washing machine 26 are a number of conventional mechanical and electromechanical elements, including a motor 32, a start relay 34, a motor speed control winding 36, a lid switch 38, and hot and cold water valve solenoids 40 and 42. The motor 32 is connected through a conventional mechanical transmission (not shown) to drive an agitator 43, and reverses direction to effect either a spin or an agitate operation, in cooperation with the transmission, in a well-known manner. For user control, a selector switch 44 is provided, the state of which is sensed by the microcontroller 22 through selected ones of the input/output lines 24.

From FIG. 1, it can be seen that relay RL1 controls energization of the motor 32. Relay RL2 controls motor direction (agitate or spin). Relay RL3 controls motor speed. Relays RL4 and RL5 respectively control the hot and cold water solenoids 40 and 42.

Also connected to and driven by the microcontroller 22 is a user display 46 which, among other things, indicates cycle Time Remaining, based on a count down cycle timer, for example within the RAM memory 23, and maintained by software within the microcontroller 22.

In this regard, included within the microcontroller 22 memory 23 is a memory location 48 storing a variable Time Remaining, which implements the count down cycle timer. Alternatively, a hardware register may be employed. In either event, it will be appreciated that the cycle timer is a counter which, during operation, has a counter state which is intended to reflect time remaining in a cycle.

Considering exemplary programming within the microcontroller 22, FIG. 2 is a flowchart of a routine 50 which maintains the FIG. 1 cycle timer 48. It will be appreciated that FIG. 2 represents a process which executes concurrently with the remainder of the programming described hereinbelow, and somewhat independently. The FIG. 2 routine is executed at regular predetermined intervals, for example every 1/120 second, and has a single step, that of Box 52, where the cycle timer 48 is decremented by an appropriate amount, for example 1/120 second, whereupon the routine exits at 54.

Any one of a variety of known microcontroller techniques may be employed to implement the periodic calling of the FIG. 2 routine. As one example, the FIG. 2 routine may be an interrupt routine. However, in the approach of the above-incorporated concurrently-filed application Ser. No. 07/968,991, the FIG. 1 Maintain Cycle Timer routine 50 is included as part of a program main loop which executes entirely through every 1/120 second. The program main loop includes an initial program step which waits for a zero crossing of the 60 HZ 120 VAC input power line, and then allows the entire program main loop to execute, whereupon execution again waits for the next zero crossing of the AC power line.

Figure 3A:
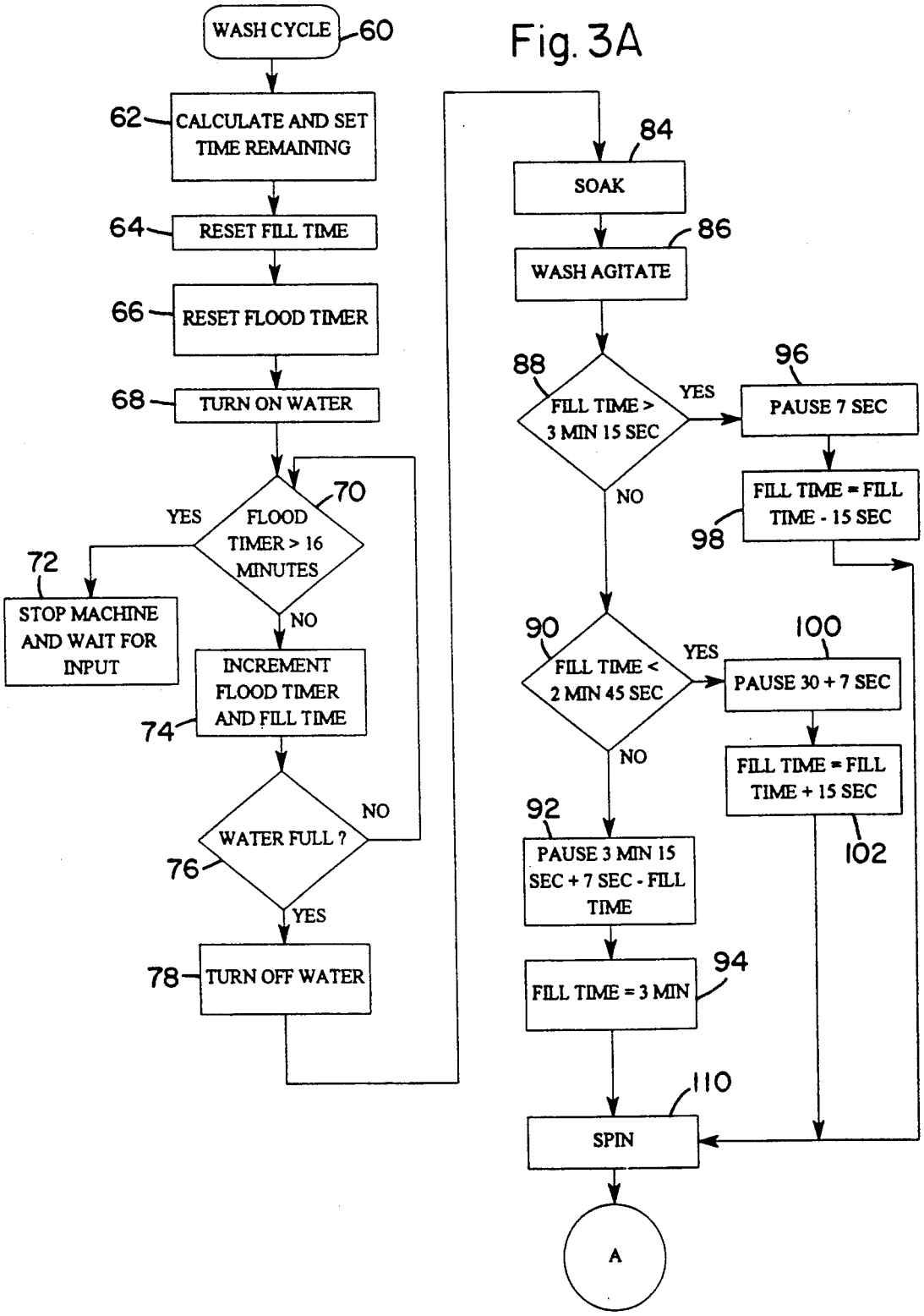
Figure 3B:
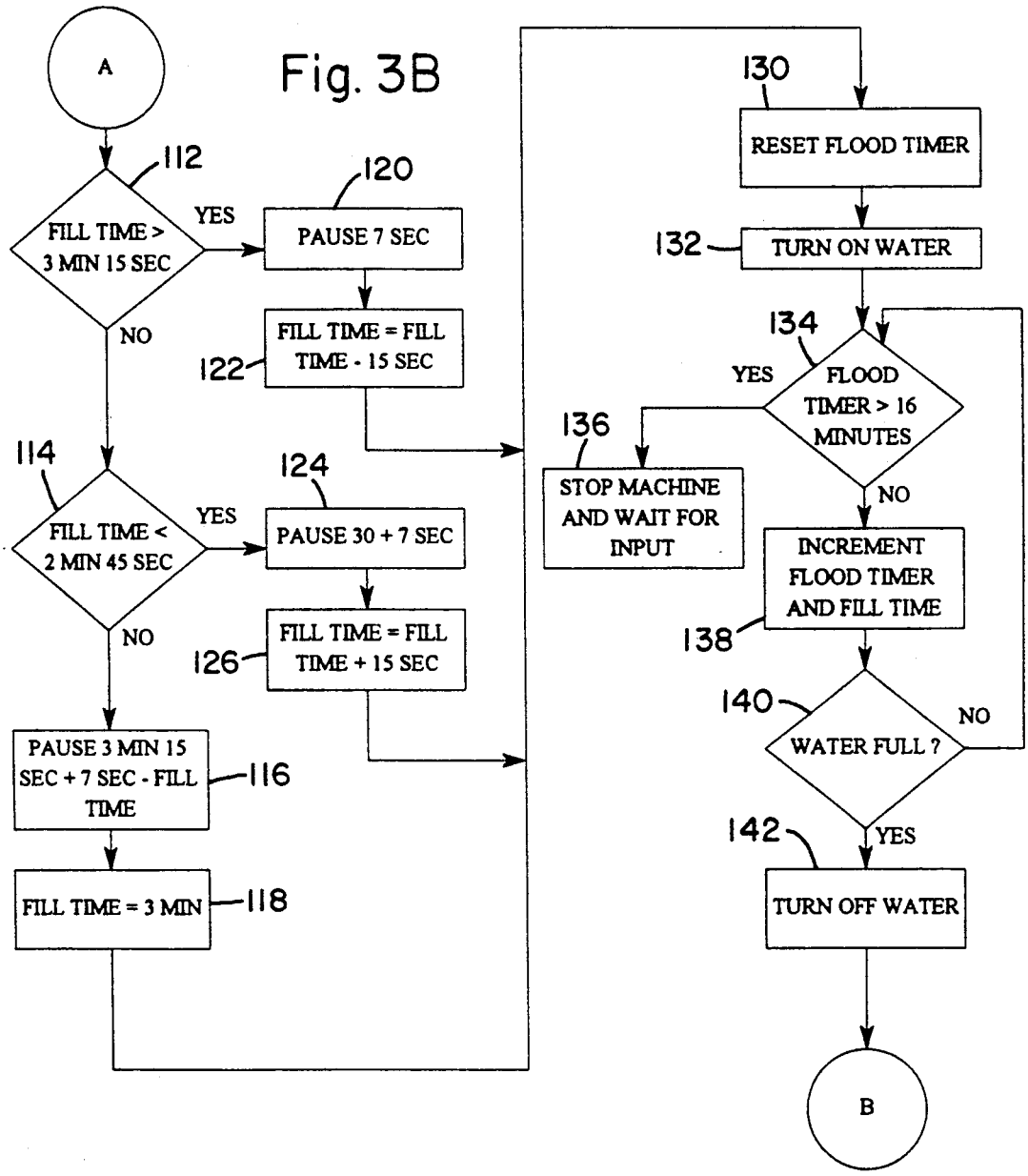

FIGS. 3A, 3B and 3C illustrate a simplified flowchart for a wash cycle which includes the fill time compensation of the invention. What are effectively the same flowchart steps implemented in a slightly different manner are disclosed in the above-incorporated concurrently-filed application Ser. No. 07/968,991. Although the results are the same, a fundamental difference in approach is that the flowchart of FIGS. 3A, 3B and 3C herein implies a sequential series of operations through a washing machine cycle, whereas, in the more comprehensive flowchart of the above-identified application Ser. No. 07/968,991, the entire routine is executed 120 times a second, and, during each time through, certain operations are executed or not depending upon the status of various flags which are maintained.

In overview, the Wash Cycle routine 60 of FIGS. 3A, 3B and 3C effects an operational cycle including a plurality of operational modes established in a predetermined sequence. By way of example, the following TABLE depicts the operational modes of a typical wash cycle, and the duration of each:

TABLE

| Operational Mode | Duration |
|---|---|
| WASH FILL | 3 minutes nominal |
| SOAK | 2 minutes fixed |
| WASH AGITATE | 11.75 minutes fixed |
| FIRST PAUSE | 15 + 7 seconds nominal |
| FIRST SPIN | 3.5 minutes fixed |
| SECOND PAUSE | 15 + 7 seconds nominal |
| RINSE FILL | 3 minutes nominal |
| RINSE AGITATE | 2 minutes fixed |
| THIRD PAUSE | 15 + 7 seconds nominal |
| FINAL SPIN | 5.5 minutes fixed |

From the foregoing TABLE, it will be seen that most of the operational modes are of a fixed time duration, with the exception of the two fill operations, which have a nominal duration of three minutes each, and the three pause intervals which have nominal durations of fifteen seconds plus seven seconds each. In accordance with the invention, differences between the actual duration of the fill operations and the nominal fill time is compensated for, to the extent possible, by adjusting the durations of the pause intervals. Accordingly, the initial setting of the Time Remaining cycle timer accurately reflects the total cycle time, and accurately reflects "Time Remaining" as a wash cycle proceeds. It will be appreciated that, in accordance with the disclosure of the above-incorporated concurrently-filed application Ser. No. 07/969,139, the "fixed" time durations in the foregoing TABLE are subject to programming for various durations. Nevertheless, ordinarily at the beginning of a particular machine operational cycle these durations are fixed for that particular cycle.

In FIG. 3A, the first execution step is in Box 62 where the count down timer 48 is initialized to a state representing the nominal total cycle time by summing the durations of the operational modes of the wash cycle, such as in the TABLE example above, and storing the result as the variable Time Remaining. (Thereafter the FIG. 2 routine decrements the variable Time Remaining at predetermined intervals.)

Next, in a series of steps beginning with Box 64 and ending with Box 78, a wash fill operation of three minutes nominal duration is performed, while measuring the actual duration. In particular, a variable Fill Time, here used as a timer variable, is utilized to track the actual time required for the fill operation. The timer variable Fill Time is reset at Box 64. A timer variable Flood Timer, a safety feature to prevent excessive flooding from malfunctioning water level sensors, is reset at Box 66, and likewise subsequently tracks actual fill time. In Box 68, signals are output to actuate either or both of the hot and cold water solenoids 40 and 52. During the filling operation, a loop is executed in which the value of the timer variable Flood Timer is repeatedly checked against a predetermined value, sixteen minutes, at decision Box 70. If the value of the timer variable Flood Timer exceeds sixteen minutes, all machine functions are stopped; the water solenoids 40 and 52 are turned off, and the machine is placed into an error mode at Box 72. This error mode persists until additional coinage sufficient for a vend is deposited, the machine is placed into diagnostics mode, or the machine experiences a power outage. If it is determined that the machine has not been filling for over sixteen minutes, the timer variables Flood Timer and Fill Time are incremented at Box 74 and a full condition is checked for at decision Box 76 which interrogates the state of the input from the FIG. 1 level sensor 29. If the full condition does not exist, the program loops back to decision Box 70 where the status of the timer variable Flood Timer is again checked. If the full condition exists at decision Box 76, the water solenoids are turned off at box 78.

In the absence of an error condition, the actual duration of the wash fill is determined by the time it takes a predetermined amount of water to enter the washing machine to eventually actuate the water level sensor 29, and at this point is indicated by the value of the timer variable Fill Time.

In the specific example disclosed herein, an actual wash fill duration within the range of 3 minutes ±15 seconds can be completely compensated for by adjusting the duration of the first pause interval as is described below. An actual wash fill duration within the range of 3 minutes ±30 seconds can be completely compensated for by adjusting the durations of the first and second pause intervals. An actual wash fill duration outside the range of 3 minutes ±15 seconds but within the range 3 minutes ±30 seconds is compensated for by adjusting the duration of the first pause interval to the extent possible, and subsequently adjusting the duration of the second pause interval to compensate for the remaining difference between the duration of the wash fill operation and the nominal fill time.

In Box 84 a soak operation occurs, followed by wash agitate in Box 86 where the motor 32 is energized in the direction which causes agitation. Both the soak and the wash agitate operations occur for fixed time durations.

From the TABLE hereinabove, it will be seen that the next operation is the first pause interval, which has a nominal duration of fifteen plus seven seconds. However, in accordance with the invention, to compensate for fill time variations the duration of the first pause interval is adjusted to the extent possible to accommodate variations in the fill time from the three minute nominal fill time.

Considering first the situation where compensation can be completely effected, in decision Box 88 the variable Fill Time is compared with three minutes fifteen seconds and, if Fill Time is not greater than three minutes fifteen seconds, execution proceeds to decision Box 90, where the variable Fill Time is compared to two minutes forty five seconds. If the variable Fill Time is not less than two minutes forty five seconds, then it follows that the actual fill time is within the range of three minutes ±fifteen seconds whereupon, in Box 92, the first pause interval is caused to occur with a duration equal to three minutes fifteen seconds plus seven seconds minus the variable Fill Time. Thus, in Box 92, the resultant duration of the first pause interval is within the range of from zero plus seven to thirty plus seven seconds. Then, in Box 94, the variable Fill Time is reset to three minutes.

Considering now a situation where the actual fill time was greater than three minutes fifteen seconds (slow fill), in decision Box 88 the answer is yes, whereupon execution proceeds to Box 96 where a predetermined absolute minimum pause interval is established, int his example seven seconds. Then, in Box 98, the variable Fill Time is adjusted by subtracting fifteen seconds, since fifteen seconds of the long fill time have been compensated for in Box 96.

Conversely, if the fill was relatively fast such that the fill time in Box 90 is determined to be less than two minutes forty five seconds, then in Box 100 a pause interval of an arbitrary maximum is established, in this example thirty plus seven seconds. Then, in Box 102, the variable Fill Time is increased by adding the fifteen seconds which were compensated for in Box 100.

After the first pause, of whatever length, execution proceeds to Box 110 where a first spin of fixed duration is effected.

Next, in order to adjust the duration of the second pause interval to compensate for any remaining difference between the duration of the first fill operation and the nominal fill time, to the extent possible, execution proceeds to decision Box 112 to determine whether the value of the variable Fill Time (after adjustment in either Box 94, 98 or 102) is greater than three minutes fifteen seconds. If not, execution proceeds to decision Box 114 which asks whether the variable Fill Time is less than two minutes forty five seconds. If not, then Box 116, which may be compared to Box 92, adjusts the duration of the second pause interval to compensate for the remaining difference in the fill time, and in Box 118 the value of the variable Fill Time is set to three minutes.

In the same manner as discussed above with reference to Boxes 96, 98, 100 and 102, in the event the fill was slow and the value of the variable Fill Time is still greater than three minutes fifteen seconds, in Box 120 a minimum duration pause of seven seconds is established, and in Box 122 the value of the variable fill time is adjusted.

Conversely, in the event of a fast fill, in decision Box 114 the value of the variable Fill Time may be less than two minutes 45 seconds, in which case execution proceeds to Box 124 where a pause of maximum duration, e.g. thirty plus seven seconds, is established, and in Box 126 the value of the variable Fill Time is increased by fifteen seconds.

In any event, execution then proceeds to Box 130. The steps of Boxes 130, 132, 134, 136, 138, 140 and 142 perform a rinse fill operation of three minutes nominal duration, with the timer variable Flood Timer as a safety device, in generally the same manner as described above with reference to Boxes 66, 68, 70, 72, 74, 76 and 78. Just as in the case of the wash fill, the actual duration of the rinse fill may be greater or less than the nominal three minute fill time.

In a variation of the approach of Boxes 66, 68, 70, 72, 74, 76 and 78, in the sequence beginning with Box 130 the timer variable Fill Time is not reset. The value of the variable Fill Time is simply increased by an amount which reflects the actual duration of the rinse fill. Employing this approach, rather than resetting the variable Fill Timer, allows the total fill variation time to be tracked with one timer.

Upon completion of the rinse fill, cycle timer correction, if needed, is carried out. This amounts to a one time adjustment of the cycle timer 48 in the event either extremely fast fills or extremely slow fills have occurred.

Thus, decision Boxes 150 and 152 serve to recognize this condition, and cause the cycle timer 48 to be jumped, forward or backward as is appropriate, and additionally to adjust the value of the variable Fill Time to control the actual duration of the third pause interval.

More particularly, in the event of extremely slow fills, where the adjustments of Boxes 96, 98, 120 and 122 were insufficient, in decision Box 150 it is determined that the value of the variable Fill Time is greater than six minutes fifteen seconds. The comparison value six minutes fifteen seconds is used because six minutes is twice the three minute nominal fill time for the wash fill and the rinse fill, and fifteen seconds is the nominal duration of the third pause interval. Under these conditions, execution proceeds to Box 154 where the cycle timer 48 variable Time Remaining is increased, in a one-time adjustment, to indicate to the user the actual cycle time remaining. As indicated, the cycle timer is increased by a value equal to the variable Fill Time minus six minutes fifteen seconds. Then, in Box 156, the value of the variable Fill Time is reset to six minutes fifteen seconds.

Conversely, in the event of extremely fast filling operations where the adjustments of Boxes 100, 102, 124 and 126 were insufficient, in decision Box 152 the value of the Variable Fill Time is less than five minutes forty five seconds, in which case execution proceeds to Box 158 where the cycle timer 48 which reflects time remaining is decreased to indicate to the user the actual time remaining in the wash cycle. As indicated in Box 158, the cycle timer is decreased by an amount equal to five minutes forty five seconds minus the value of the variable Fill Time. Then, in Box 160, the value of the variable Fill Time is set to five minutes forty five seconds.

In any event, an agitate operation is effected in Box 162.

Box 164 establishes the third pause interval. The third pause interval have a nominal duration of fifteen plus seven seconds. However, the actual duration of the third pause interval is between seven and thirty plus seven seconds, being determined by subtracting the value of the variable Fill Time from the constant 6.25 minutes.

The final spin occurs in Box 166, and the wash cycle ends at Box 168.

While specific embodiments of the invention have been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. A washing machine electronic control system comprising:

a count down timer;

a time remaining display indicating cycle time remaining based on the state of said count down timer; and control means for effecting an operational cycle of a washing machine comprising a sequence of operational modes, the operational modes including at least one fill operation having a duration defined by the actual time required for a predetermined amount of liquid to enter the washing machine, and at least one pause interval, the operational cycle having a nominal total cycle time which includes a nominal fill time for the at least one fill operation and a nominal time duration for the at least one pause interval;

said control means being operable to maintain said time remaining display by initializing said count down timer to a state representing the nominal total cycle time and by decrementing said count down timer at regular predetermined intervals, to measure the duration of the at least one fill operation, and to adjust the duration of the at least one pause interval to the extent possible to compensate for any difference between the duration of the at least one fill operation and the nominal fill time so as to tend to achieve the nominal total cycle time.

2. A washing machine electronic control system in accordance with claim 1, wherein said control means are further operable, in the event the difference between the duration of the at least one fill operation and the nominal fill time exceeds the compensation that can be achieved by adjusting the duration of the at least one pause interval, to adjust the state of said count down timer to a state which represents actual cycle time remaining.

3. A washing machine electronic control system in accordance with claim 1, wherein:

said control means are operable to effect an operational cycle comprising operational modes including at least first and second pause intervals each having a nominal time duration; and wherein said control means are further operable, in the event the difference between the duration of the at least one fill operation and the nominal fill time exceeds the compensation that can be achieved by adjusting the duration of the first pause interval, to adjust the duration of the second pause interval to the extent possible to compensate for any remaining difference between the duration of the at least one fill operation and the nominal fill time so as to tend to achieve the nominal total cycle time.

4. A washing machine electronic control system in accordance with claim 3, wherein said control means are further operable, in the event the duration of the at least one fill operation and the nominal fill time exceeds the compensation that can be achieved by adjusting the durations of the at least first and second pause intervals, to adjust the state of said count down timer to a state which represents actual cycle time remaining.

5. A washing machine electronic control system in accordance with claim 1, wherein:

said control means are operable to effect an operational cycle comprising operational modes including first and second fill operations each having a duration defined by the actual time required for a predetermined amount of liquid to enter a washing machine, the at least one fill operation comprising the first fill operation, and including at least one initial pause interval prior to the second fill operation and a subsequent pause interval after the second fill operation, the pause intervals each having a nominal time duration, the at least one pause interval comprising the at least one initial pause interval; and wherein said control means are further operable to measure the duration of the second fill operation and to adjust the duration of the subsequent pause interval to the extent possible to compensate for any difference between the combined durations of the first and second fill operations and twice the nominal fill time to the extent not previously compensated for so as to tend to achieve the nominal total cycle time.

6. A washing machine electronic control system in accordance with claim 5, wherein said control means are further operable, in the event the combined durations of the fill operations exceed the compensation that can be achieved by adjusting the durations of the pause intervals, to adjust the state of said count down timer to a state which represents actual cycle time remaining.

7. A washing machine electronic control system in accordance with claim 1, wherein:

said control means are operable to effect an operational cycle comprising operational modes including first, second and third pause intervals each having a nominal time duration, and including first and second fill operations each having a duration defined by the actual time required for a predetermined amount of liquid to enter a washing machine; and wherein said control means are further operable, in the event the difference between the duration of the first fill operation and the nominal fill time exceeds the compensation that can be achieved by adjusting the duration of the first pause interval, to adjust the duration of the second pause interval to the extent possible to compensate for any remaining difference between the duration of the first fill operation and the nominal fill time so as to tend to achieve the nominal total cycle time, and are further operable to measure the duration of the second fill operation and to adjust the duration of the third pause interval to the extent possible to compensate for any difference between the combined durations of the first and second fill operations and twice the nominal fill time to the extent not previously compensated for so as to tend to achieve the nominal total cycle time.

8. A washing machine electronic control system in accordance with claim 7, wherein said control means are further operable, in the event the combined durations of the fill operations exceed the compensation that can be achieved by adjusting the duration of the pause intervals, to adjust the state of said count down timer to a state which represents actual cycle time remaining.

9. A washing machine electronic control system comprising:

control means for effecting an operational cycle for a washing machine comprising a sequence of operational modes, the operational modes including at least one fill operation having a duration defined by the actual time required for a predetermined amount of liquid to enter the washing machine, and at least one pause interval, the operational cycle having a nominal total cycle time which includes a nominal fill time for the at least one fill operation and a nominal time duration for the at least one pause interval;

said control elements being operable to measure the duration of the at least one fill operation, and to adjust the duration of the at least one pause interval to the extent possible to compensate for any difference between the duration of the at least one fill operation and the nominal fill time so as to tend to achieve the nominal total cycle time.

10. A washing machine electronic control system in accordance with claim 9, wherein:

said control means are operable to effect an operational cycle comprising operational modes including at least first and second pause intervals each having a nominal time duration; and wherein said control means are further operable, in the event the difference between the duration of the at least one fill operation and the nominal fill time exceeds the compensation that can be achieved by adjusting the duration of the first pause interval, to adjust the duration of the second pause interval to the extent possible to compensate for any remaining difference between the duration of the at least one fill operation and the nominal fill time so as to tend to achieve the nominal total cycle time.

11. A washing machine electronic control system in accordance with claim 9, wherein:

said control means are operable to effect an operational cycle comprising operational modes including first and second fill operations each having a duration defined by the actual time required for a predetermined amount of liquid to enter the washing machine, the at least one fill operation comprising the first fill operation, and including at least one initial pause interval prior to the second fill operation and a subsequent pause interval after the second fill operation, the pause intervals each having a nominal time duration, the at least one pause interval comprising the at least one initial pause interval; and wherein said control means are further operable to measure the duration of the second fill operation and to adjust the duration of the subsequent pause interval to the extend possible to compensate for any difference between the combined durations of the first and second fill operations and twice the nominal fill time to the extent not previously compensated for so as to tend to achieve the nominal total cycle time.

12. A washing machine electronic control system in accordance with claim 9, wherein:

said control means are operable to effect an operational cycle comprising operational modes including first, second and third pause intervals each having a nominal time duration, and including first and second fill operations each having a duration defined by the actual time required for a predetermined amount of liquid to enter a washing machine; and wherein said control means are further operable, in the event the difference between the duration of the first fill operation and the nominal fill time exceeds the compensation that can be achieved by adjusting the duration of the first pause interval, to adjust the duration of the second pause interval to the extent possible to compensate for any remaining difference between the duration of the first fill operation and the nominal fill time so as to tend to achieve the nominal total cycle time, and are further operable to measure the duration of the second fill operation and to adjust the duration of the third pause interval to the extent possible to compensate for any difference between the combined durations of the first and second fill operations and twice the nominal fill time to the extent not previously compensated for so as to tend to achieve the nominal total cycle time.

13. A washing machine electronic control system in accordance with claim 1, which further comprises a flood timer, wherein the predetermined amount of liquid is sensed by a liquid level sensor, and wherein said control means is operable to prevent excessive flooding in the event the liquid level sensor malfunctions by employing the flood timer to track actual fill time during a filling operation, periodically comparing actual fill time as tracked by the flood timer to a predetermined value, and terminating operation in the event the actual fill time exceeds the predetermined value.

14. A washing machine electronic control system comprising:

a flood timer;

control means for effecting an operational cycle of a washing machine comprising a sequence of operational modes including at least one fill operation having a duration defined by the time required for a predetermined amount of liquid to enter the washing machine as sensed by a liquid level sensor; and said control means being operable to prevent excessive flooding in the event the liquid sensor malfunctions by employing the flood timer to track actual fill time during a filling operation, periodically comparing actual fill time as tracked by the flood timer to a predetermined value, and terminating operation in the event the actual fill time exceeds the predetermined value.

15. A method for controlling a washing machine so as to achieve a constant total cycle time notwithstanding variations in the duration of filling operations, the washing machine being of the type which has an operational cycle comprising a sequence of operational modes, the operational modes including at least one fill operation having a duration defined by the actual time required for a predetermined amount of liquid to enter the washing machine, and at least one pause interval having a nominal pause time duration, said method comprising:

causing the fill operation to occur and measuring the actual time required for the at least one fill operation; and adjusting the duration of the at least one pause interval to compensate for any differences between the actual time required for the fill operation and a nominal fill time such that the total cycle time is equal to the cycle time which would occur if the actual time required for the fill operation were the nominal fill time and if the pause interval were for the nominal pause time duration.

* * * * *